US011267648B2

(12) United States Patent
Lin

(10) Patent No.: US 11,267,648 B2
(45) Date of Patent: Mar. 8, 2022

(54) INDUCTIVE TRASH CAN STRUCTURE

(71) Applicant: Heng-Hsing Lin, New Taipei (TW)

(72) Inventor: Heng-Hsing Lin, New Taipei (TW)

( * ) Notice: Subject to any disclaimer, the term of this patent is extended or adjusted under 35 U.S.C. 154(b) by 204 days.

(21) Appl. No.: 16/702,456

(22) Filed: Dec. 3, 2019

(65) Prior Publication Data

US 2021/0163220 A1 Jun. 3, 2021

(51) Int. Cl.
*B65F 1/16* (2006.01)

(52) U.S. Cl.
CPC ..... *B65F 1/1638* (2013.01); *B65F 2210/168* (2013.01)

(58) Field of Classification Search
CPC ..... B65F 1/1638; B65F 2210/168
USPC ..... 220/211, 262, 263, 822, 254.4
See application file for complete search history.

(56) References Cited

U.S. PATENT DOCUMENTS 1,448,589 A * 3/1923 Ferguson ..... B65D 47/26 220/822
2,969,142 A * 1/1961 Mack ..... A45D 40/065 401/59
7,819,728 B2 * 10/2010 Beckley ..... B60N 3/106 454/155
7,906,921 B2 * 3/2011 Wang ..... B65F 1/1607 318/266
2007/0182551 A1 * 8/2007 Yang ..... B65F 1/08 340/545.3

* cited by examiner

*Primary Examiner* — J. Gregory Pickett
*Assistant Examiner* — Niki M Eloshway
(74) *Attorney, Agent, or Firm* — Leong C. Lei

(57) ABSTRACT

An inductive trash can structure mainly includes a upper cover assembly constituted by a combination seat, rotary frame, rotary protrusion and rotary sheets, control element, first elastic element, engagement element, drive assembly constituted by a movable carrier, engagement rod and drive element, linkage switch, at least one second elastic element, at least one inductor and at least one power supply. The rotary sheets is used as a trash can cover to reduce the space required for a cover opening action, the inductor is adapted to open and close the upper cover assembly with its automatic induction to increase use hygiene, the first elastic element is used to open the cover instantly, and the closing of the drive assembly allows use safety.

10 Claims, 16 Drawing Sheets

INDUCTIVE TRASH CAN STRUCTURE

(a) TECHNICAL FIELD OF THE INVENTION

The present invention relates to an inductive trash can structure occupying small space and having a mechanism of very quick automatic cover opening and trash can close safety protection.

(b) DESCRIPTION OF THE PRIOR ART

Automatic cover-lifting type trash covers being opened with an inductor is no doubt hygienic, but it always make users inconvenient because trash can covers are still not opened or opened too slow due to the slow rotating speed of motors even when they have stood beside trash cans for a while and are ready to throw garbage.

In addition, mechanical automatic opening structures are also users' consideration factors in use safety; current safety mechanisms are always set up using inductors, and trash cans are closed when users do not exist. However, the response thereof may be not good due to dirty or malfunction because the configurations of inductors generally have blind spots such that use safety cannot be ensured. In addition, a motor will occupy internal space of a trash can when it is installed inside the trash can, causing not only internal usable space of the trash can to become small but the opening of the trash can to be narrowed.

SUMMARY OF THE INVENTION

The main object of the present invention is to use the cooperation of an inductor, linkage switch and first elastic element to realize the progressiveness of automatic cover opening and instant cover opening, and use the cooperation of an engagement element and engagement rod to cause an drive assembly to be separated from a control element to interrupt mechanical force closing action when the closing of the upper cover assembly is abnormally blocked, thereby accurately achieving safety protection.

To achieve the above object, the present invention proposes an inductive trash can structure, including: a upper cover assembly, including a combination seat adapted to be in combination with a upper edge of a trash can, a rotary frame movably configured on the combination seat, a rotary protrusion configured on one side of the rotary frame, and a plurality of rotary sheets configured on the rotary frame, the rotary sheets synchronously rotated with the rotary frame to shield an opening of the trash can; a control element, configured on one side of the trash can and adapted to move the rotary protrusion therewith; a first elastic element, configured on the control element and adapted to move the control element therewith to cause the upper cover assembly to be opened; an engagement element, configured on one side of the control element; a drive assembly, configured on one side of the control element and adapted to move the control element therewith to cause the upper cover assembly to be closed, the drive assembly including a pivotally coupled movable carrier configured on one side of the engagement element, an engagement rod configured on the movable carrier and adapted to be in engagement with the engagement element, and a drive element configured on the movable carrier and adapted to move the engagement rod therewith; a linkage switch, configured on one side of the drive assembly and adapted to push the movable carrier, allowing the engagement rod to be separated from the engagement element; at least one second elastic element, configured on one side of the drive assembly and adapted to pull the movable carrier back to cause the engagement rod to be in engagement with the engagement element; at least one inductor, configured on one side of the upper cover assembly, and adapted to drive the linkage switch when sensing an object and close the action of the linkage switch and start the drive element after a predetermined time, and at least one power supply, in electric connection with the drive element, linkage switch and inductor.

when garbage is thrown even under a condition of the upper cover assembly being closed, the linkage switch can also push the movable carrier to separate the engagement rod from the engagement element of the control element at the moment when the inductor detects the garbage, and the elastic force of the first elastic element is used to rotate the control element and further to move the rotary protrusion of the rotary frame therewith to cause the rotary frame to drive the rotary sheets to move to open the trash can quickly by accepting the rotary sheets on the combination seat. Furthermore, the linkage switch is automatically closed after a few seconds after the induction is completed, and the elastic force of the second elastic element causes the engagement rod to be in engagement with the engagement element again and open the drive device at the same time. Then, the drive element controls the engagement rod to rotate to drive the control element to move to push the rotary protrusion reversely to make the rotary sheets to shield the opening of the trash can.

Whereby, the present invention can breakthrough the problems of conventional automatic inductive trash cans of the larger cover opening space requirement, the longer cover opening response time or action time, and insufficient security mechanism. Therefore, the present invention achieves the progressiveness of the above advantages.

DETAILED DESCRIPTION OF THE PREFERRED EMBODIMENTS

Figure 1:
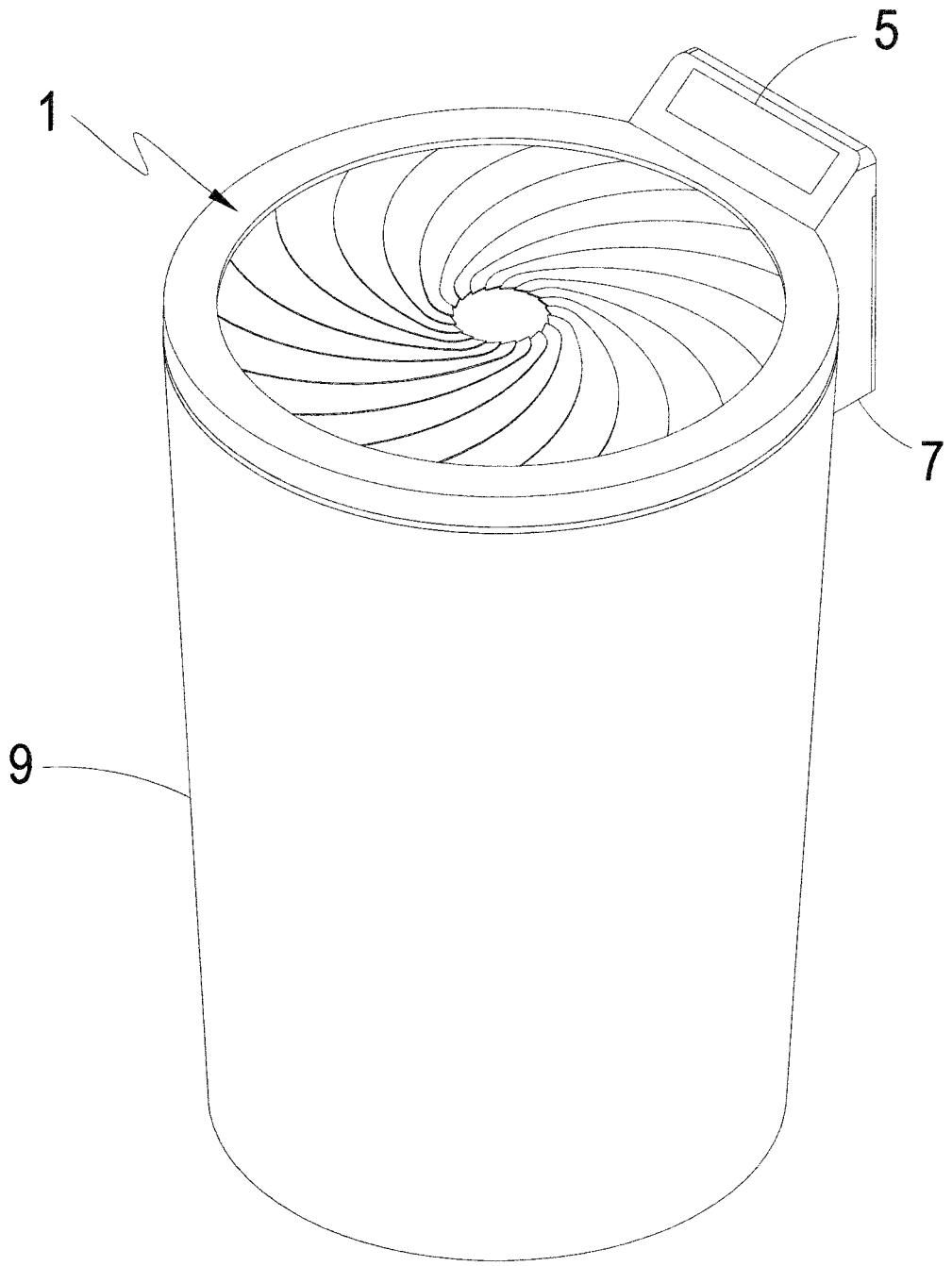
FIG. 1 is a perspective view of a preferred embodiment of the present invention.
Figure 2:
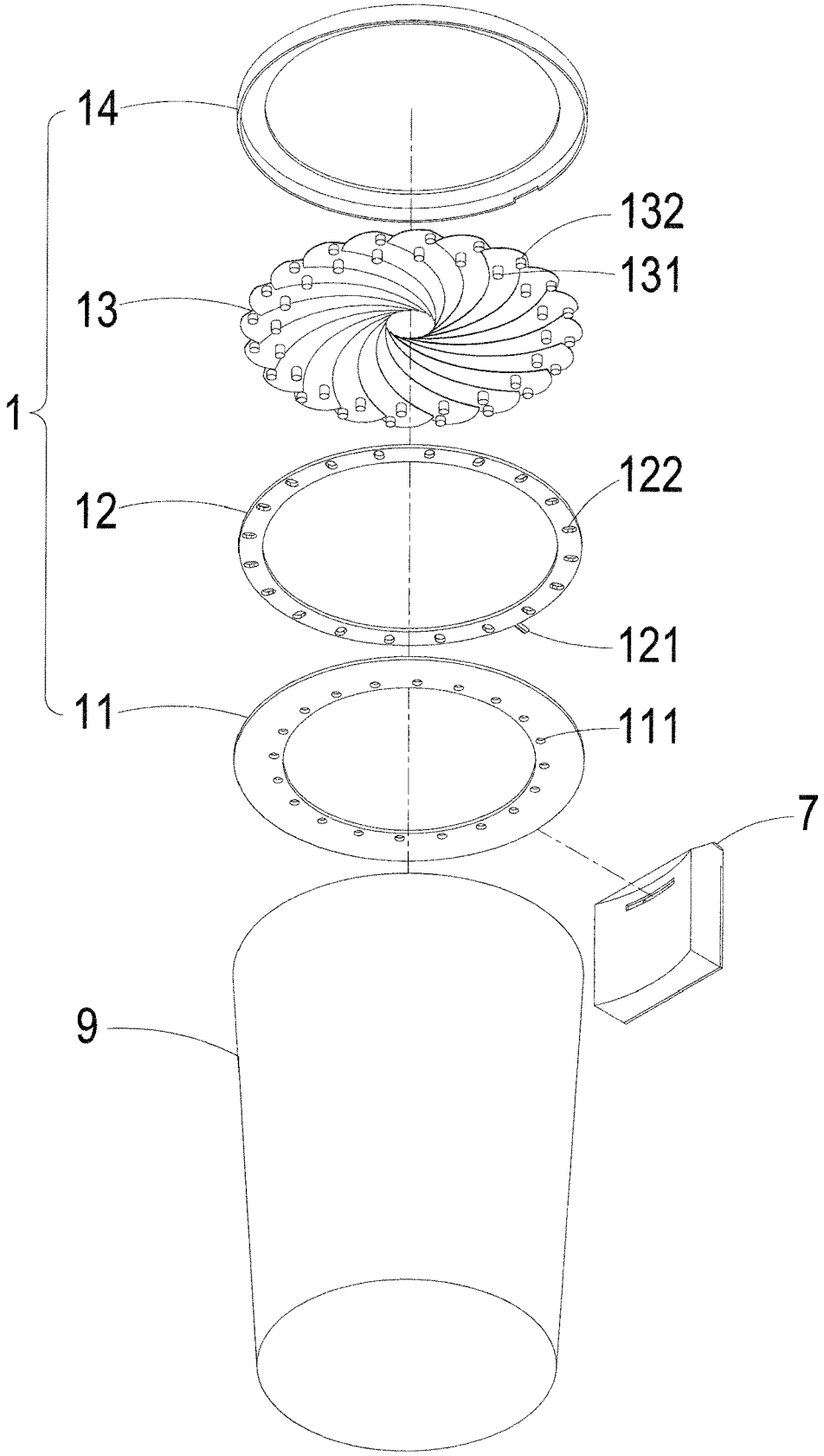
FIG. 2 is an exploded view of the embodiment of the present invention when viewing from another angle.
Figure 3:
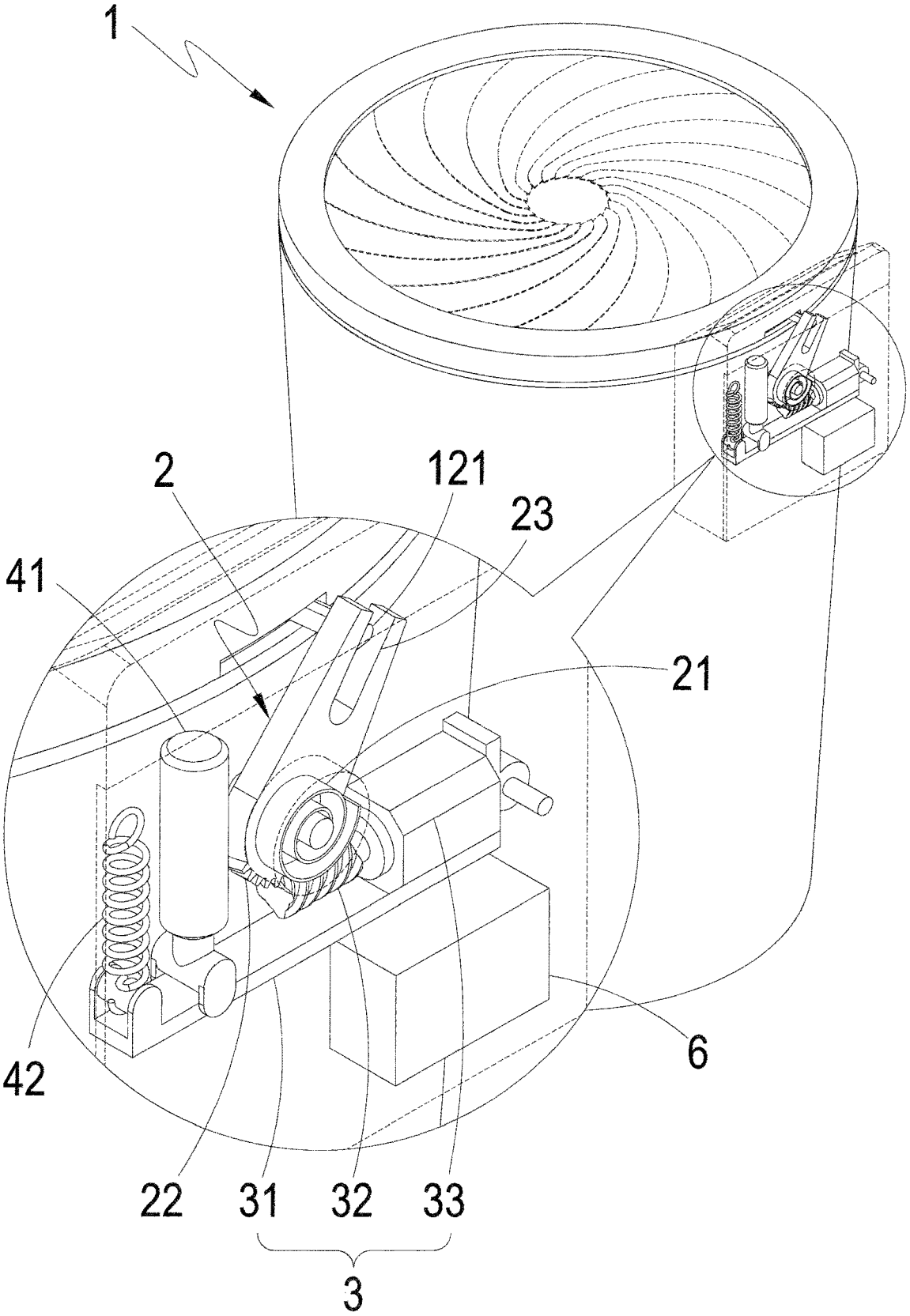
FIG. 3 is a perspective view of the embodiment of the present invention when viewing from another angle.

Referring to FIGS. 1 to 3, an inductive trash can structure of the present invention includes a upper cover assembly 1, a control element 2, a first elastic element 21, an engagement element 22, a drive assembly 3, a linkage switch 4, at least one second elastic element 42, an outer shell 7, at least one inductor 5 and at least one power supply 6.

The upper cover assembly 1 includes a combination seat 11 coupled to a trash can 9, a rotatable frame 12 movably configured on the combination seat 11, a rotary protrusion 121 formed on the periphery of the rotating frame 12, a plurality of rotary sheets 13 and a fixing covering body 14 adapted to fix these rotary sheets 13 adapted to swing synchronously with the rotation of the rotating frame 12 to close the opening of the trash can 9, each of which includes a positioning portion 131 and an abutting portion 132 configured at one side of the positioning portion 131, and the combination seat 11 has a plurality of positioning holes 111 combined with corresponding positioning portions 131. Furthermore, a plurality of abutting holes 122 combined with corresponding abutting portions 132 are configured on the rotating frame 12.

The control element 2 is configured on one side of the trash can 9 and adapted to control the rotary protrusion 121 to move with it, where the control element 2 includes a limit groove 23 adapted to limit the rotary protrusion 121.

The linkage switch 41 is configured on one side of the drive assembly 3 and adapted to push the movable carrier 31 to separate the engagement rod 32 from the engagement element 22.

The first elastic element 21 is configured on the control element 2 and adapted to move the control element 2 with it to cause the upper cover assembly 1 to be opened.

The engagement element 22 is configured on one side of the control element 2.

The drive assembly 3 is configured on one side of the control element 2 and adapted to move the control element 2 with it to cause the upper cover assembly 1 to be closed, where the drive assembly 3 includes a pivotally coupled movable carrier configured at one side of the engagement element 22, an engagement rod 32 configured on the movable carrier 31 and in engagement with the engagement element 22, and a drive element 33 configured on the movable carrier 31 and adapted to move the engagement rod 32 with it.

The second elastic element 42 is configured on one side of the drive assembly 3 and adapted to pull back the movable carrier 31, allowing the engagement rod 32 to be in engagement with the engagement element 22.

The outer shell 7 is allowed to cover the control element 2, drive assembly 3, linkage switch 41 and second elastic element 42.

The inductor 3 is configured on one side of the upper cover assembly 1 and adapted to drive the linkage switch 41 when an object is sensed and turn off the linkage switch 41 and start the drive element 33 after a predetermined period of time.

The power supply 6 is respectively in electric connection with the drive element 33, linkage switch 41 and the inductor 5.

Referring to FIGS. 1 to 13, the trash can 9 of the present invention is in combination with one rotary vane type upper cover assembly 1 so that there is no need to empty the space above the trash can 9 in order to open the cover, resulting in a small entire volume. In addition, a set of induction mechanism is configured on one side of the trash can 9 to use the power supply 6 (e.g. battery) as a power source and the inductor 5 (e.g. infrared ray inductor) to sense an object, thereby utilizing the elastic force of the first elastic element 21 to quickly open the upper cover assembly 1 and the drive element 33 (e.g. motor) to slowly close it.

Figure 4:
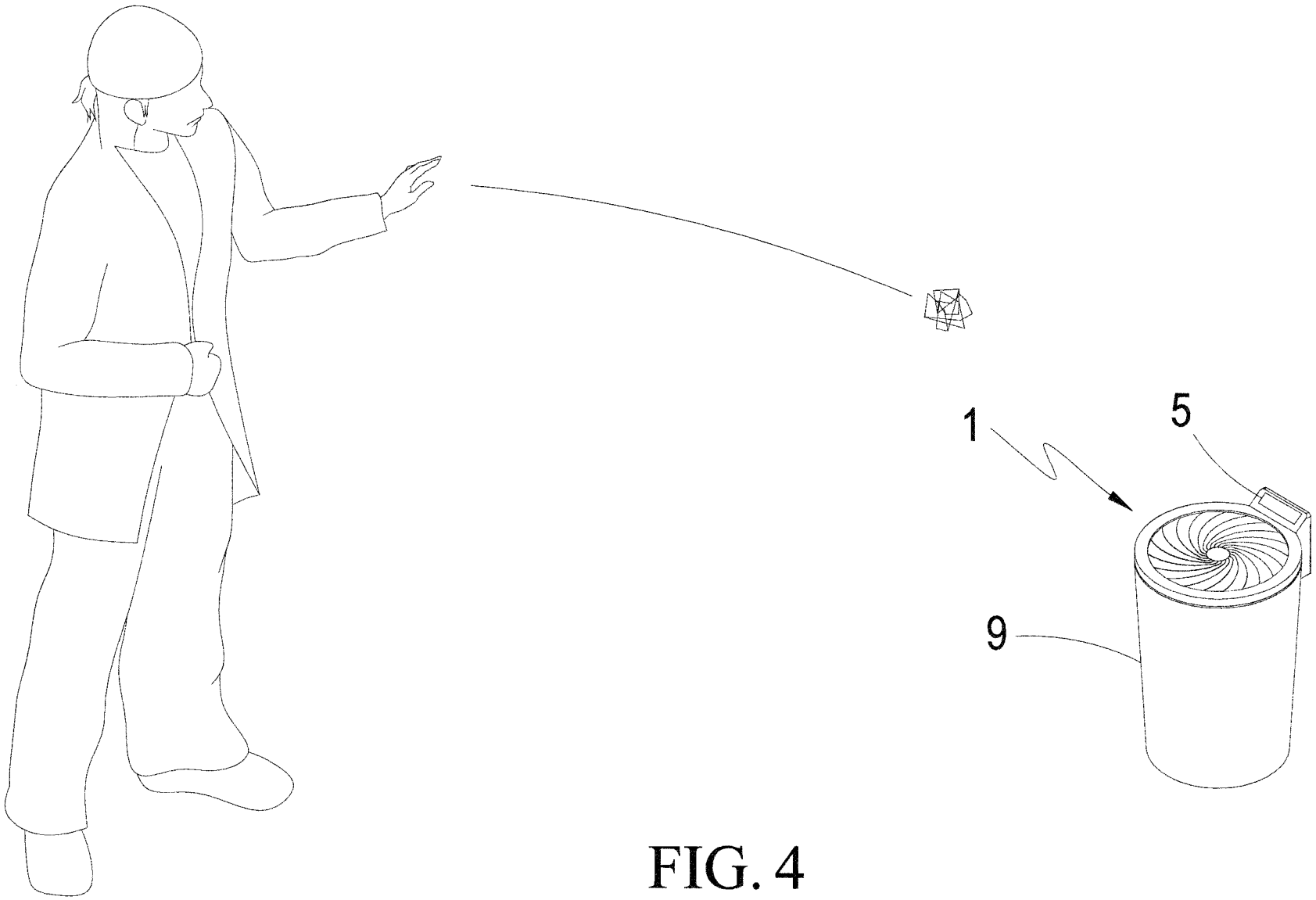
FIG. 4 illustrates the embodiment of the present invention in a use state.
Figure 5:
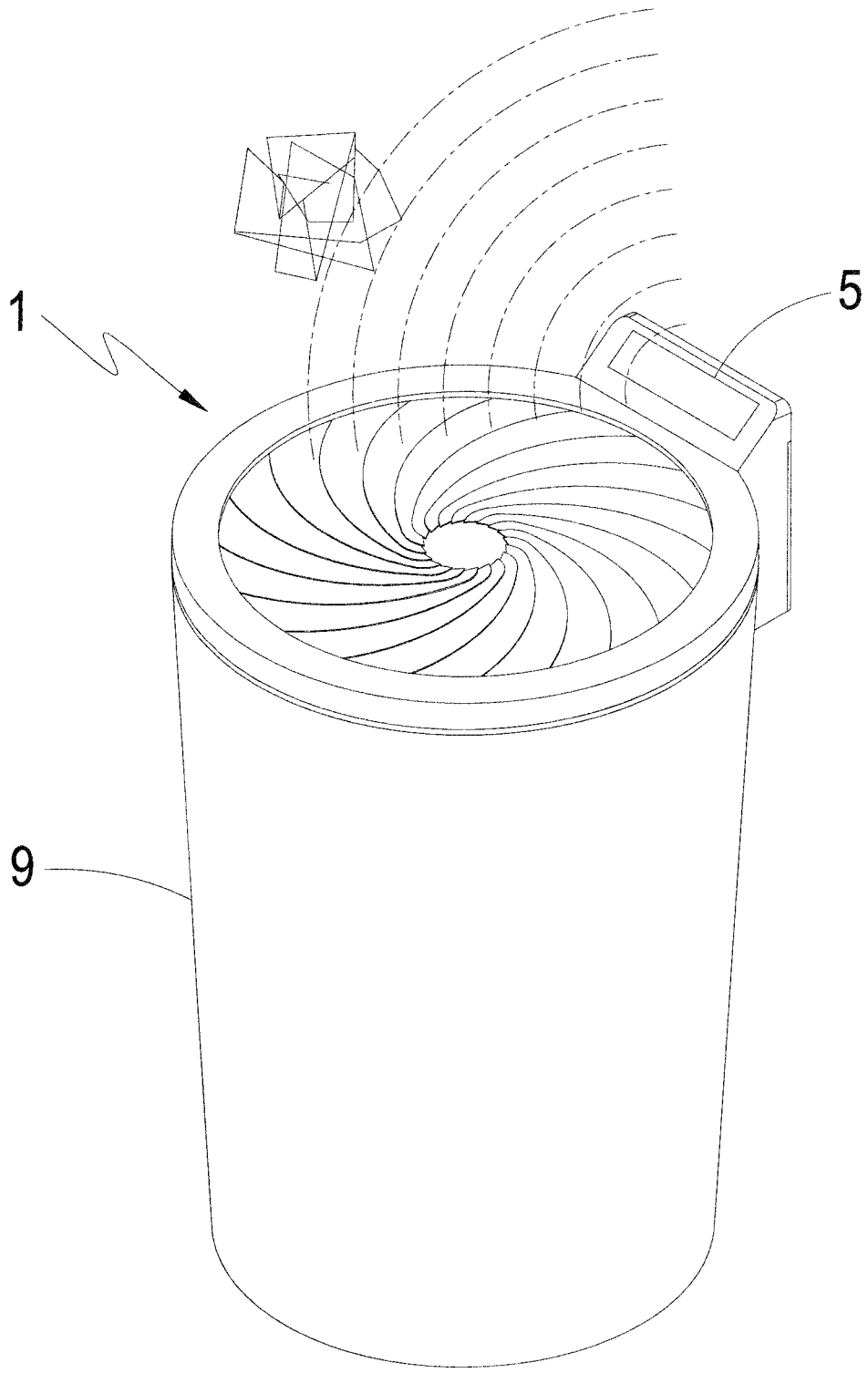
FIG. 5 illustrates the embodiment of the present invention in an induction state.
Figure 6:
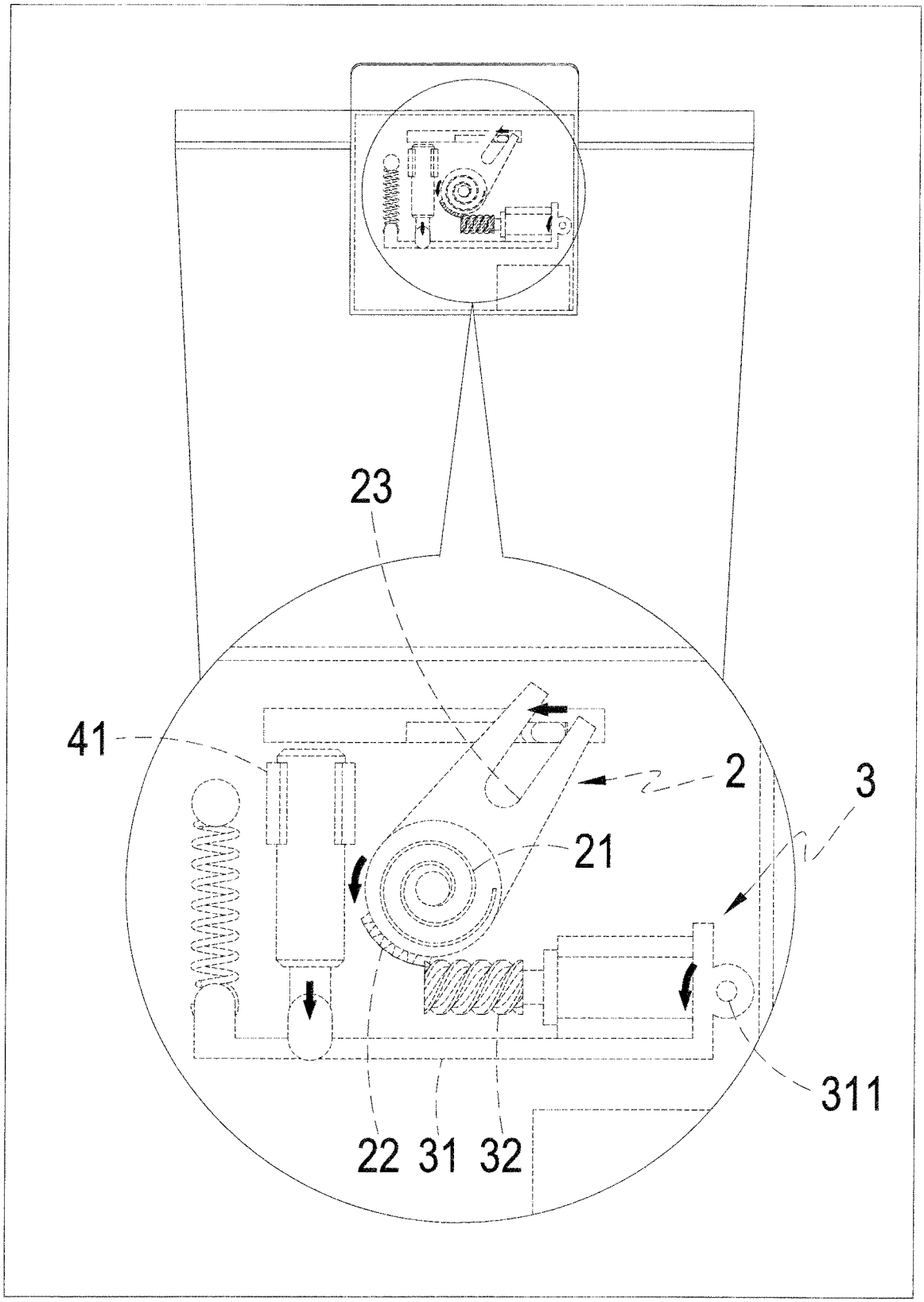
FIGS. 6 and 7 respectively show the embodiment of the present invention when a cover is being opened.
Figure 7:
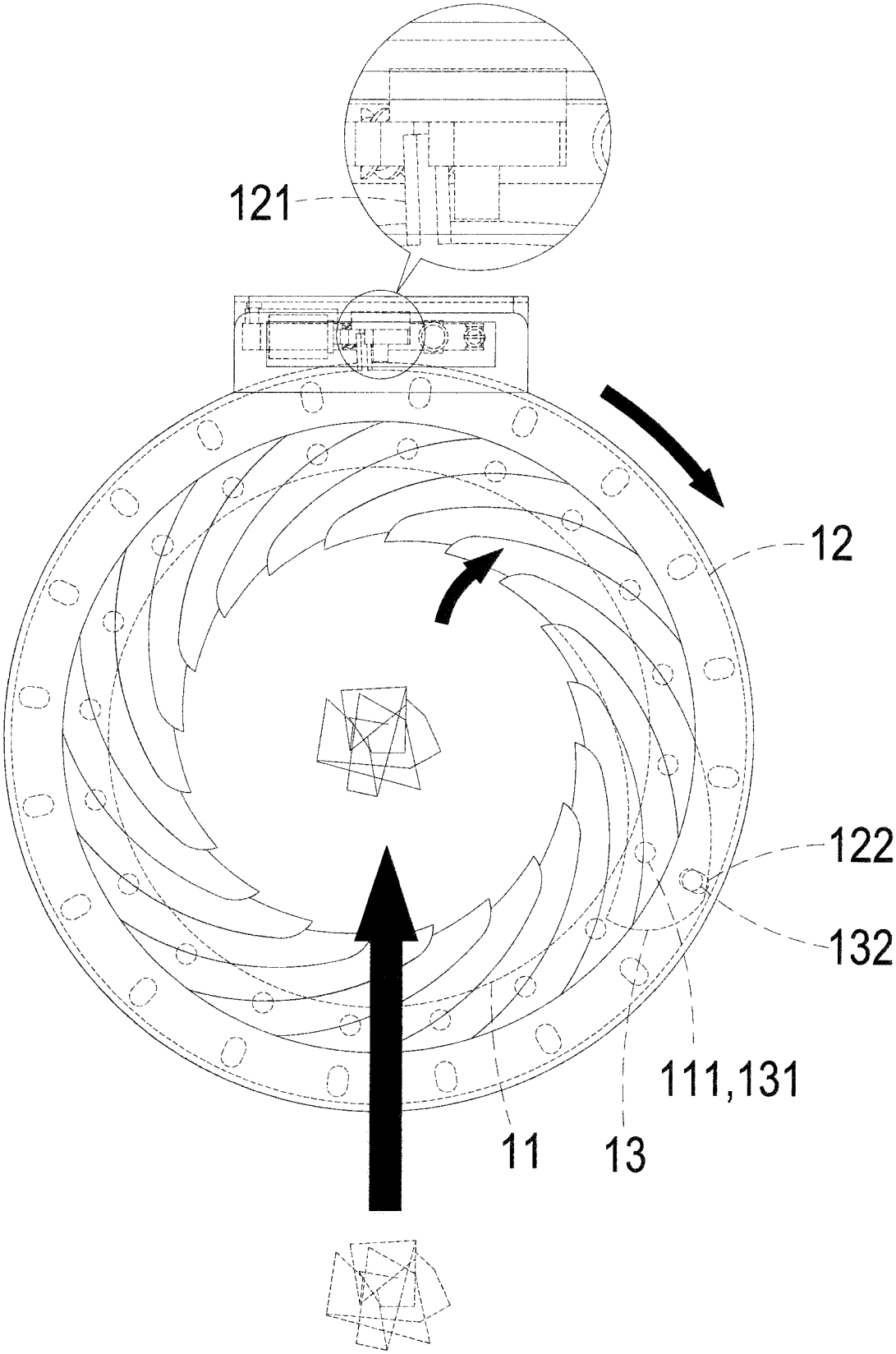
Figure 8:
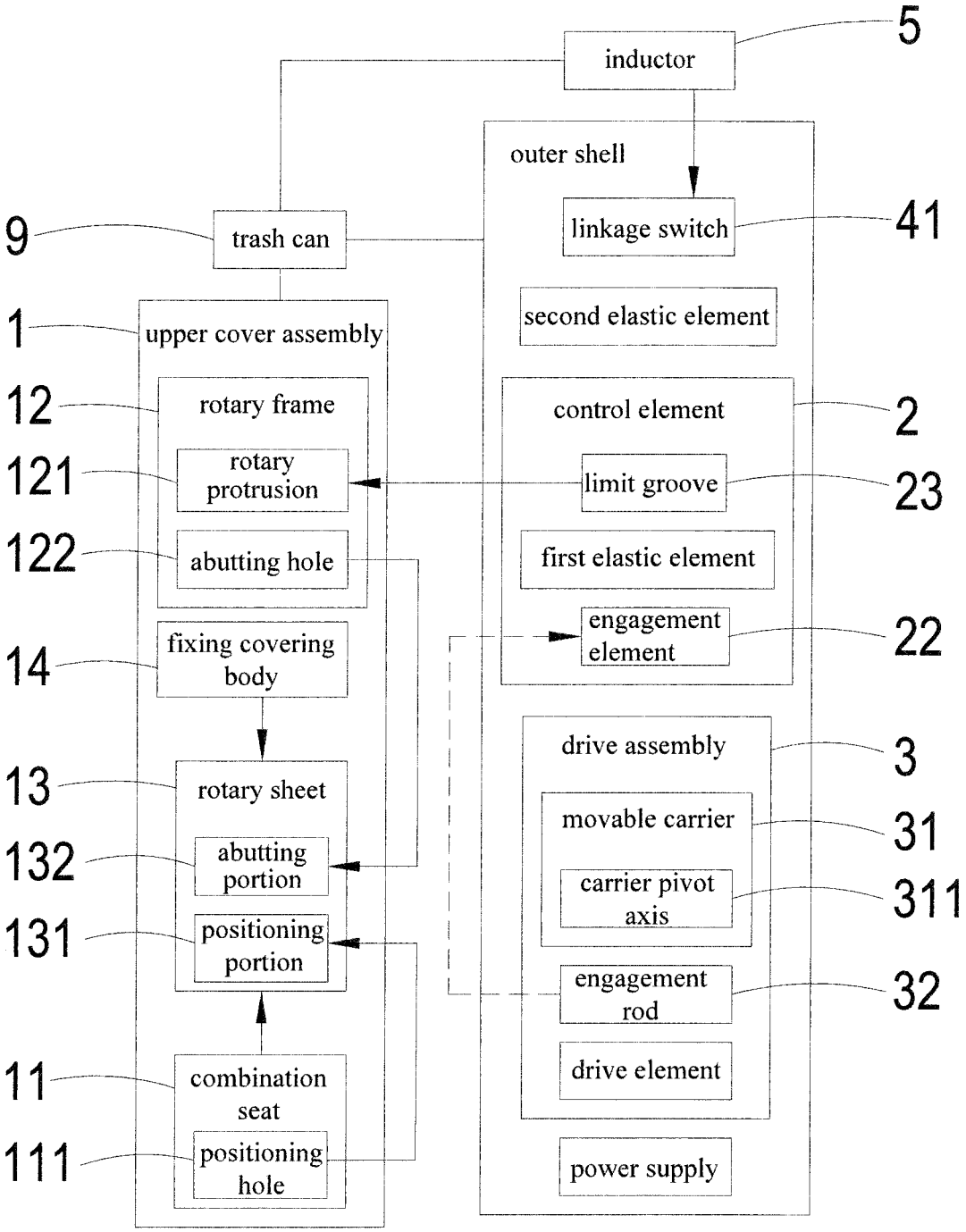
FIG. 8 is a functional block diagram of the embodiment of the present invention.

Referring to FIG. 4, a user does not need to be particularly close to the inductor 5, or waits for the upper cover assembly 1 to be opened before the garbage can be thrown when they want to throw garbage because the opening of the upper cover assembly 1 is completed instantly. Therefore, the user only needs to throw garbage inside the throwing range, and that is enough. When the garbage is close to the trash can 9 and the inductor 5 senses the garbage, the inductor 5 then sent a control signal to the linkage switch 41 (e.g. the assembly of an electromagnetic valve and cylinder) to cause the linkage switch 41 to push the movable carrier 31 of the drive assembly 3 to move to make the movable carrier 31 to swing downward around a carrier pivot axis 311, causing the engagement rod 32 of the drive assembly 3 to be separated from the engagement element 22 of the control element 2. At this time, because the engagement element 22 is not engaged with and held by the engagement rod 32, the first elastic element 21 (e.g. a spiral spring) of the control element 2 is contracted elastically to cause the control element 2 to be rotated from an tilted state to a upright state, and because the rotary protrusion 121 of the upper cover assembly 1 is positioned in the limit groove 23 of the control element 2, the rotation of the control element 2 pushes the rotary protrusion 121 to move leftward at the same time such as FIGS. 6 and 8 show. Then, the rotary protrusion 121 is forced to displace to cause the rotary frame 12 to be rotated clockwise. At this time, the rotation of the rotary frame 12 will cause each rotary sheet 13 to take its positioning portion 131 as a rotating center and be pushed by the abutting hole 122 and abutting portion 132 to rotate clockwise and accepted between the combination seat 11 and fixing covering body 14 because the positioning portion 131 of each rotary sheet 13 is coupled to the positioning hole 111 of the combination seat 11, and the abutting portion 132 the abutting hole 122 of the rotary frame 12. In a preferred embodiment, the rotary sheets number 20 such that the rotary protrusion 13 has a swing amplitude of less than 3 cm. Therefore, the rotary sheets 13 can be accepted instantly (approximately 0.1 to 0.5 seconds) through the elastic force of the first elastic element 21, which allows garbage to be smoothly thrown into the trash can 9, and the width of each rotary sheet 13 is only about 3 centimeters after the rotary sheets 13 are accepted, which has a minimal impact on the opening of the trash can 9 as FIGS. 7 and 8 show.

Figure 9:
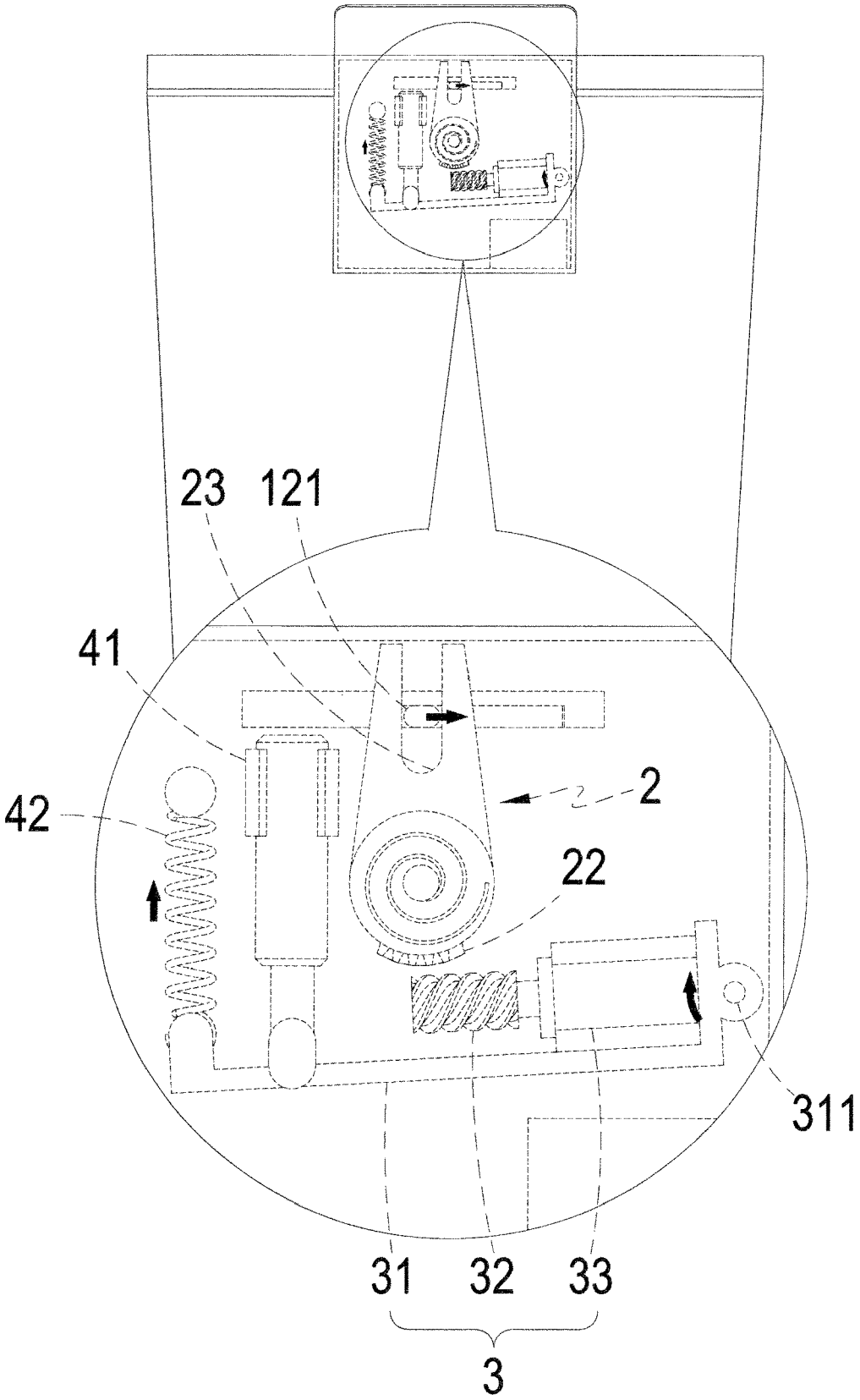
FIG. 9 is a schematic view of the embodiment of the present invention in a closing state.
Figure 10:
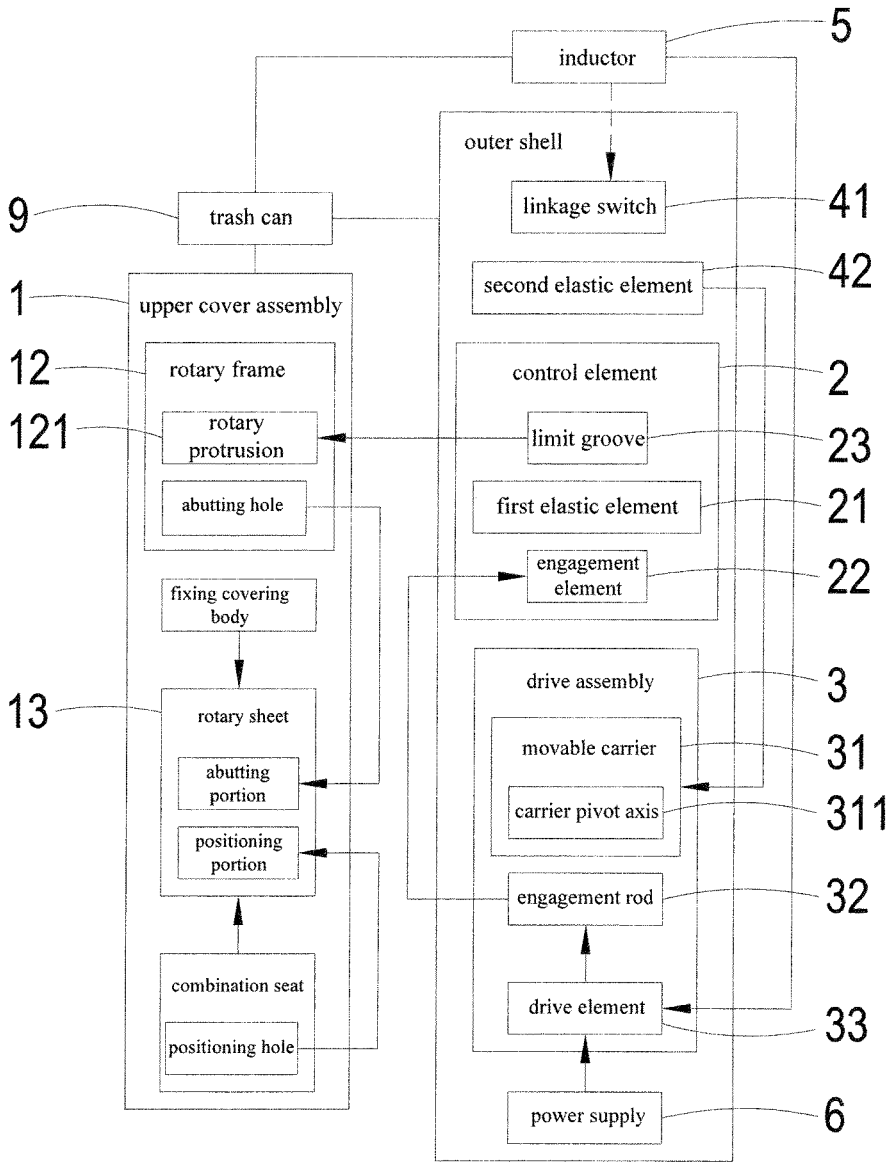
FIG. 10 is another functional block diagram of the embodiment of the present invention.

The upper cover assembly 1 is then automatically closed after a few seconds (about 3-6 seconds) after sensing by the inductor 5 as FIGS. 9 and 10 show. At this time, the inductor 5 simultaneously stops the linkage switch 41 and starts the drive assembly 3; the movable carrier 31 is elastically pulled back by the second elastic element 42 and rotated upward around the carrier pivot axis 311 to allow the engagement rod 32 of the drive assembly to be in engagement with the engagement element 22 of the control 2 again, and the drive element 33 then uses the power of the power supply 6 to rotate the engagement rod 32 to rotate the control element 2 into a tilted state through the engagement element 22. Then, the control element 2 similarly push the rotary protrusion 121 rightward through the limit groove 23 to cause the rotary frame 12 and rotary sheets 13 to move to shield the opening of the trash can 9, where the movements of the rotary frame 12 and rotary sheets 13 are contrary to the aforementioned opening action.

Figure 11:
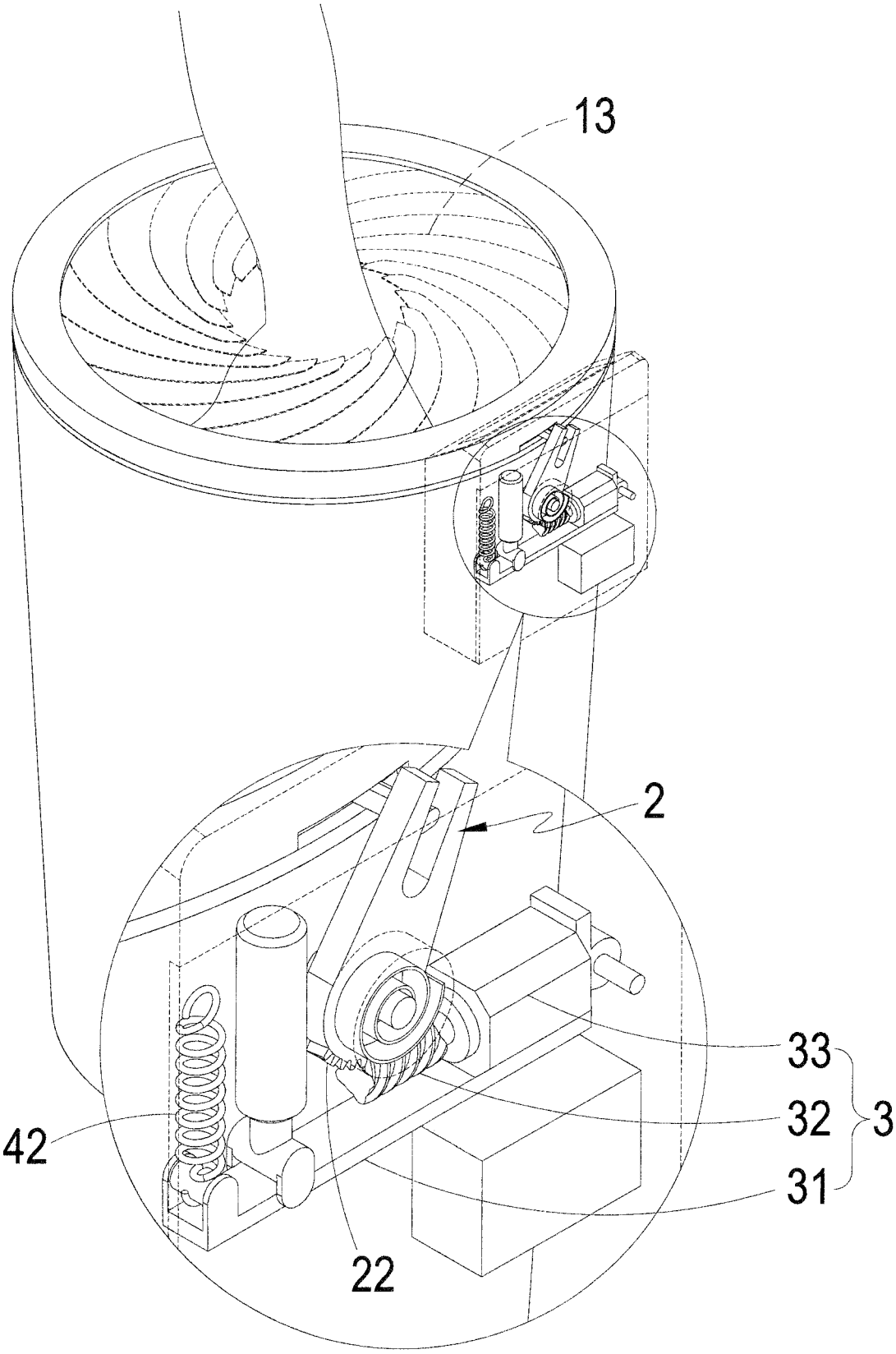
FIGS. 11 and 12 respectively illustrate the embodiment according to the present invention, where the safety protection action is shown.
Figure 12:
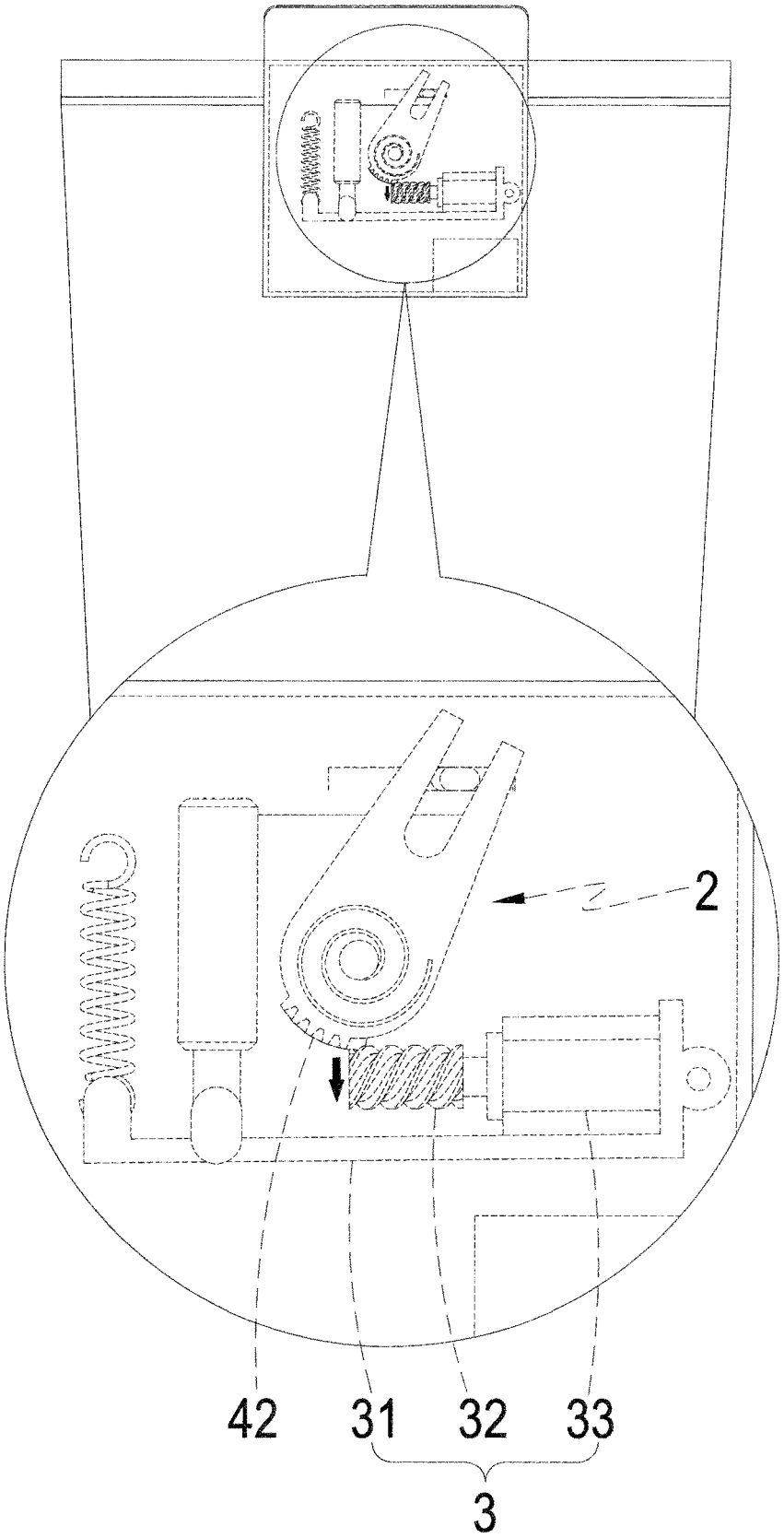
Figure 13:
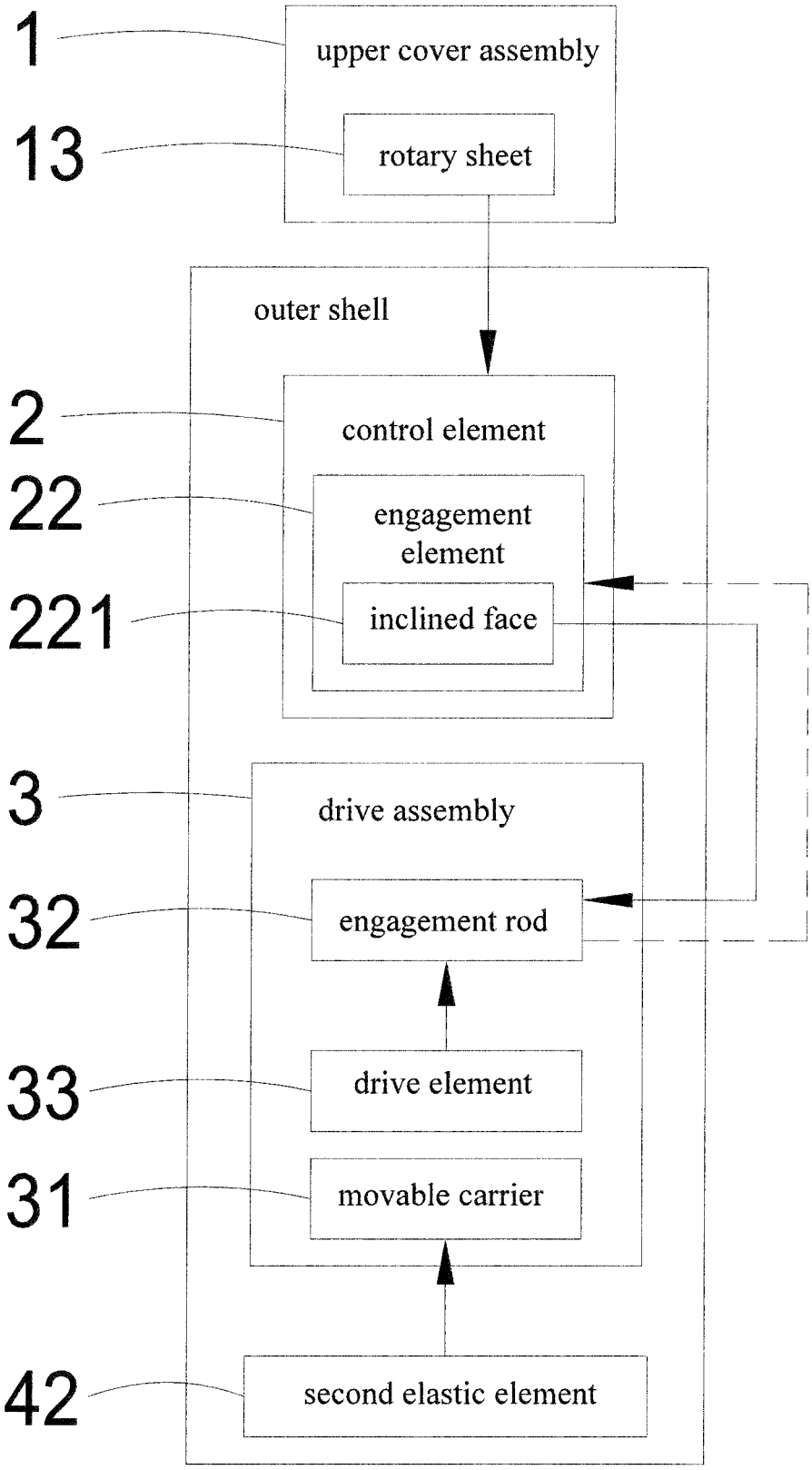
FIG. 13 is still another functional block diagram of the embodiment of the present invention.

In addition, In the process of closing the upper cover assembly 1, it is possible to have an anti-pinch function without additionally providing an anti-pinch sensor. In the process of closing the upper cover assembly 1, as FIGS. 11 to 13 show, although the shielding action of the drive assembly 3 being used to drive the rotary sheets 13 is very slow, if a child fails to pull out the arm immediately due to playfulness to cause the rotary sheets 13 to press against the arm, an inclined face 221 of the engagement element 22 feedbacks a reaction force to the engagement rod 32 due to the pushing of the engagement rod 32 because the control element 2 cannot be normally rotated rightward and the drive element 33 still continues to operate, and the reaction force of the inclined face 221 will cause the movable carrier 31 to be rotated downward to make the engagement rod 32 to be separated from the engagement element 22 again to stop the closing action of the rotary sheets 13 because the drive element 33 and engagement rod 32 are configured on the movable carrier 31 and the movable carrier 31 is supported only by the second elastic element 42, thereby accurately achieving a safe anti-pinch function.

Figure 14:
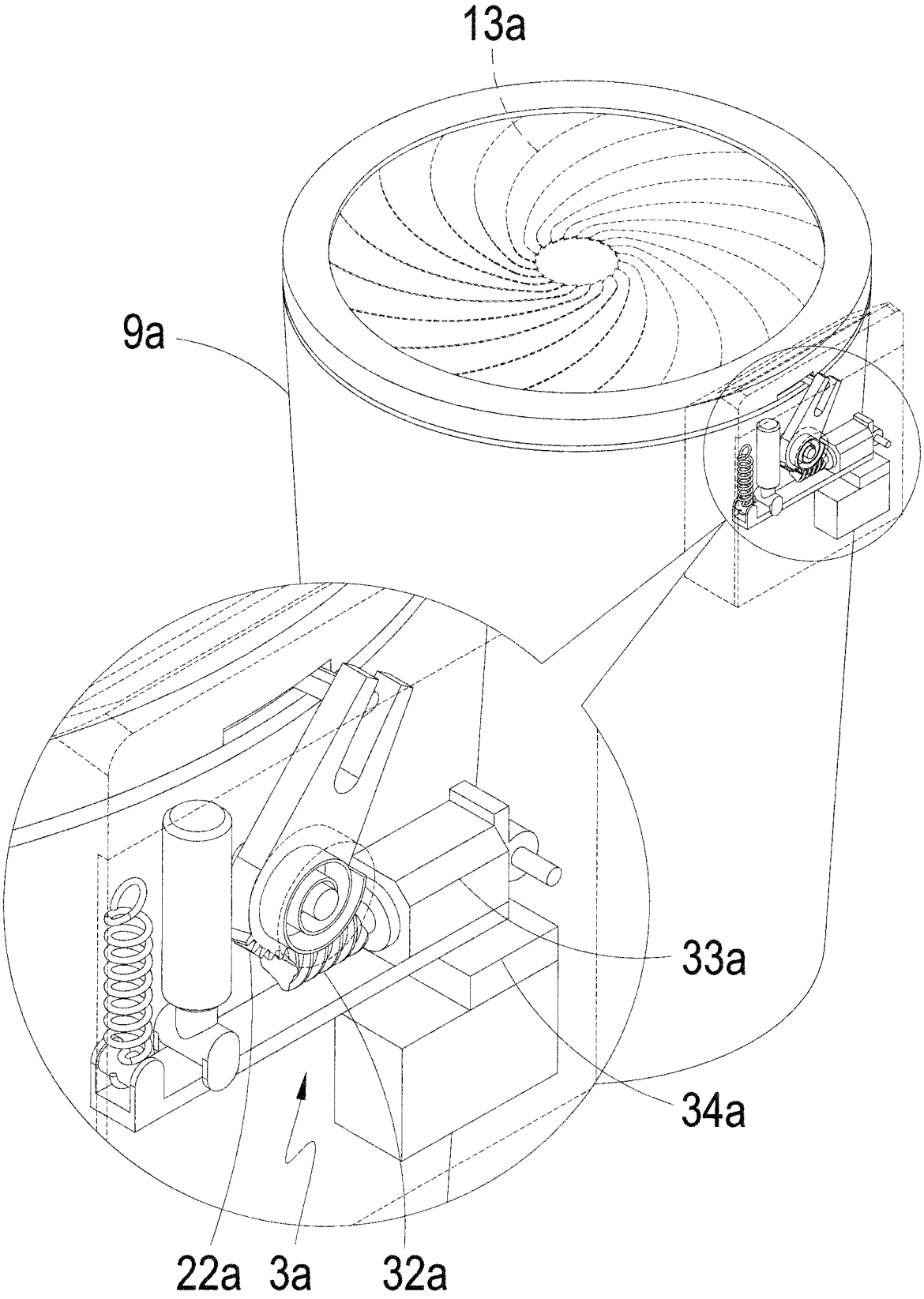
FIG. 14 is a schematically perspective view of another preferred embodiment of the present invention.

Referring to FIG. 14, which shows another preferred embodiment of the present invention, the difference between the present embodiment and the above embodiment is that in the present embodiment, a timer 34*a* adapted to control the action time of the drive element 33*a* is in electric connection with one side of the drive assembly 3*a*. Whereby, manufacturers may use the timer 34*a* to control the drive element 33*a* to stop the action of the drive element 33*a* according to the numbers of the rotary sheets 13*a* and the required closing time to prevent the extra abrasion action generated between the engagement rod 32*a* and engagement element 22*a* caused by the too long action of the drive element 33*a* so as to reduce combination abrasion degree thereof to extend product life.

Figure 15:
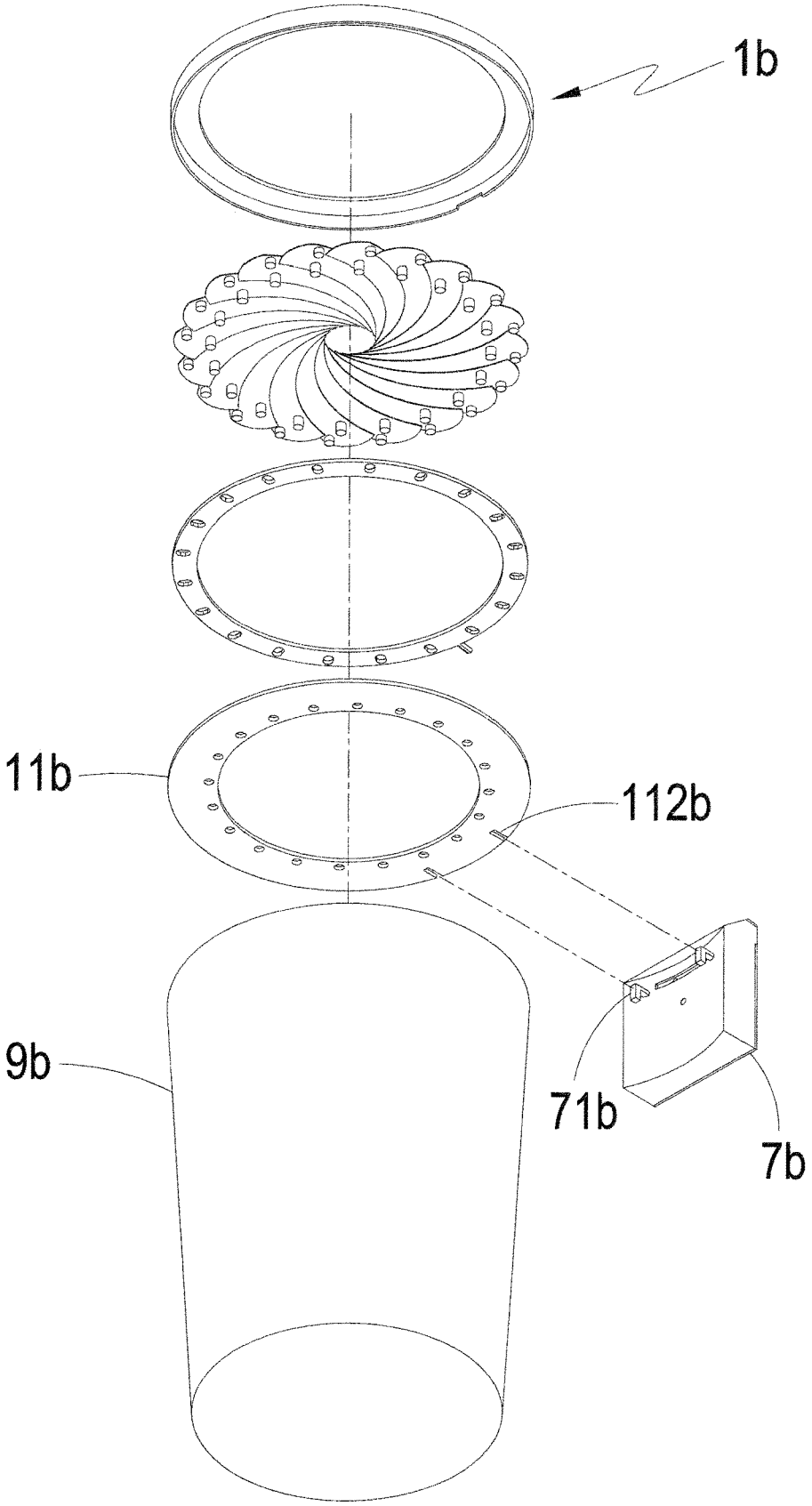
FIG. 15 is an exploded view of still another preferred embodiment of the present invention.

Referring to FIG. 15, which shows still another embodiment of the present invention, the difference between the present embodiment and the above embodiments is that in the present embodiment, at least one hanging hook 71*b* is configured on one side of the outer shell 7*b*, allowing the outer shell 7*b* to be in combination with the outer side of the trash can 9*b*. Furthermore, the combination seat 11*b* has at least one notch 112*b* corresponding to the hanging hook 71*b*, thereby allowing the trash can 9*b* and upper cover assembly 1*b* to be separated from other induction mechanism configured inside the outer shell 7*b*, which enable a user to hang the outer shell 7*b* directly on the outer edge of the opening of the trash can 9*b* by means of the hanging hooks 71*b* and then engage the notches 112*b* of the combination seat 11*b* with the hanging hooks 71*b*. In this way, a general trash can can be upgraded to the inductive trash can 9*b*.

Figure 16:
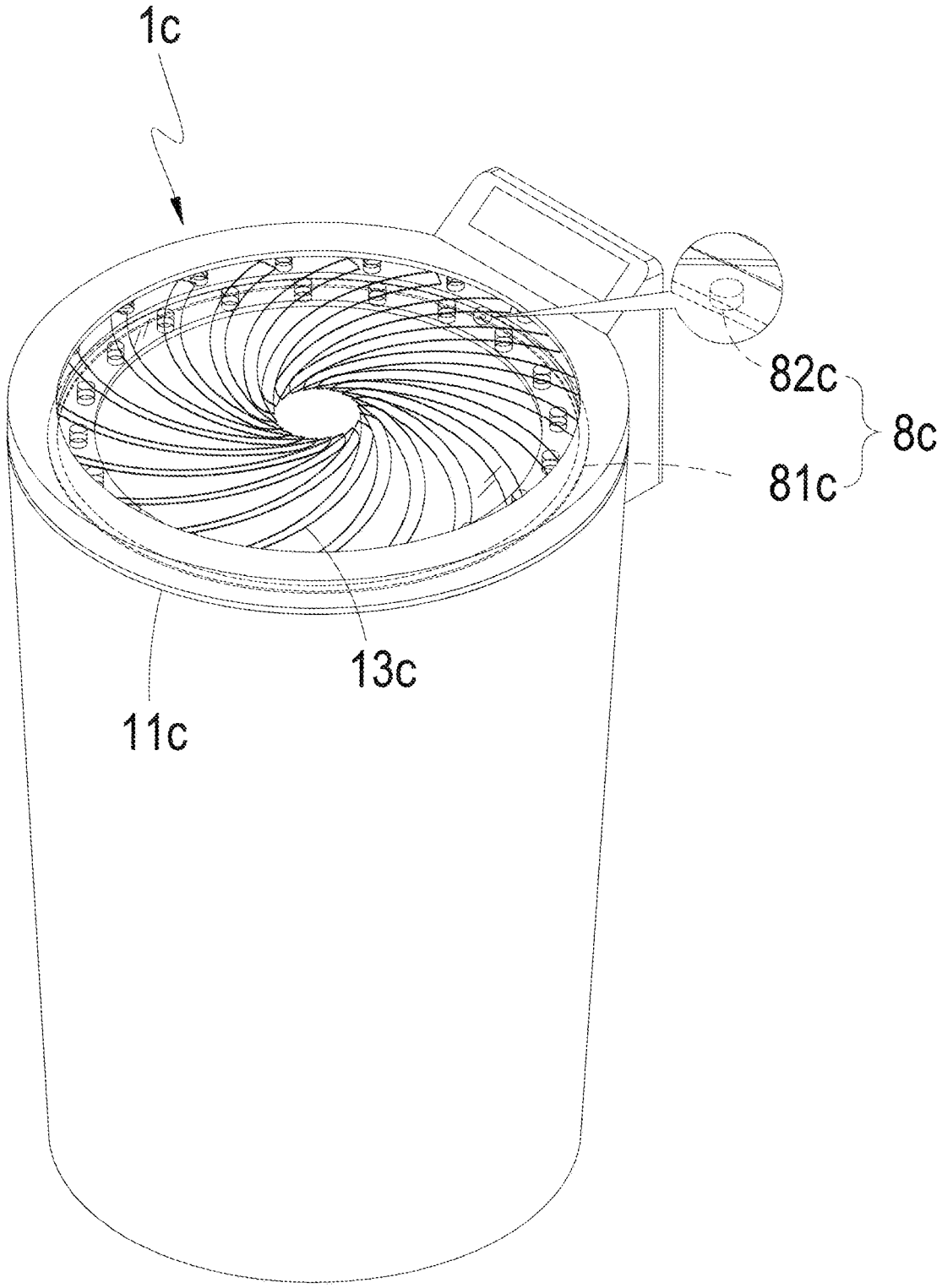
FIG. 16 is a schematically perspective view of yet another preferred embodiment of the present invention while being implemented.

Referring to FIG. 16, which shows still another preferred embodiment of the present invention, the difference between the present embodiment and the above embodiments is that in the present embodiment, the combination seat 11*c* has at least one light emitting element 8*c*. In the embodiment, each rotary sheet 13*c* of the upper cover assembly 1*c* is made from light-transmission material such as acrylic, and the bottom of the combination seat 11*c* is configured with at least one light emitting element 8*c* (in the embodiment, the light emitting element 8*c* includes a light guide strip 81*c* put around one side of the combination seat 1*c* and an LED configured on one side of the light guide strip 81*c*). Whereby, a night light effect with a halo pattern is generated through the light guide strip 81*c* when the LED 82*c* is lighted, which not only helps a user to throw garbage in the case of insufficient lighting, but also provides a certain degree of beautification.

I claim:

1. An inductive trash can structure, comprising:

an upper cover assembly, comprising a combination seat adapted to be in combination with an upper edge of a trash can, a rotary frame movably configured on said combination seat, a rotary protrusion configured on one side of said rotary frame, and a plurality of rotary sheets configured on said rotary frame, said rotary sheets synchronously rotated with said rotary frame to shield an opening of said trash can;

a control element, configured on one side of said trash can and adapted to move said rotary protrusion therewith;

a first elastic element, configured on said control element and adapted to move said control element therewith to cause said upper cover assembly to be opened;

an engagement element, configured on one side of said control element;

a drive assembly, configured on one side of said control element and adapted to move said control element therewith to cause said upper cover assembly to be closed, said drive assembly comprising a pivotally coupled movable carrier configured on one side of said engagement element, an engagement rod configured on said movable carrier and adapted to be in engagement with said engagement element, and a drive element configured on said movable carrier and adapted to move said engagement rod therewith;

a linkage switch, configured on one side of said drive assembly and adapted to push said movable carrier, allowing said engagement rod to be separated from said engagement element;

at least one second elastic element, configured on one side of said drive assembly and adapted to pull said movable carrier back to cause said engagement rod to be in engagement with said engagement element;

at least one inductor, configured on one side of said upper cover assembly, and adapted to drive said linkage switch when sensing an object and close the action of said linkage switch and start said drive element after a predetermined time, and at least one power supply, in electric connection with said drive element, linkage switch and inductor.

2. The structure according to claim 1, further comprising an outer shell, and said control element, drive assembly, linkage switch and second elastic element configured inside said outer shell.

3. The structure according to claim 2, wherein one side of said outer shell has at least one hanging hook adapted to couple said outer shell to an outer side of said trash can.

4. The structure according to claim 3, wherein said combination seat has at least one notch corresponding to said hanging hook.

5. The structure according to claim 1, wherein said rotary sheet comprises a positioning portion and an abutting portion configured at one side of said positioning portion, and said combination seat has a plurality of positioning holes coupled correspondingly to said positioning portions and said rotary frame has a plurality of abutting holes coupled correspondingly to said abutting portions.

6. The structure according to claim 1, wherein said control element comprises a limit groove adapted to limit said rotary protrusion.

7. The structure according to claim 1, wherein one side of said drive assembly is in electric connection with a timer adapted to control the action time of said drive element.

8. The structure according to claim 1, wherein said engagement element is formed with at least an inclined face.

9. The structure according to claim 1, wherein said upper cover assembly comprises a fixing covering body adapted to fix said rotary sheets.

10. The structure according to claim 1, wherein said combination seat has at least one light emitting element.

* * * * *